US005902768A

United States Patent [19]

Inoue et al.

[11] Patent Number: 5,902,768

[45] Date of Patent: May 11, 1999

[54] REVERSIBLE HEAT-SENSITIVE RECORDING MATERIAL

[75] Inventors: Yasushi Inoue; Yoshihiro Hieda, both of Osaka, Japan

[73] Assignees: Nitto Denko Corporation; Hitachi Maxell, Ltd., both of Osaka, Japan

[21] Appl. No.: 08/530,249

[22] PCT Filed: Mar. 30, 1994

[86] PCT No.: PCT/JP94/00527

§ 371 Date: Sep. 28, 1995

§ 102(e) Date: Sep. 28, 1995

[87] PCT Pub. No.: WO95/26883

PCT Pub. Date: Oct. 12, 1995

[30] Foreign Application Priority Data

Sep. 30, 1992 [JP] Japan ..... 4-286831

[51] Int. Cl.[6] ..... B41M 5/34; B41M 5/40

[52] U.S. Cl. ..... 503/200; 503/201; 503/226

[58] Field of Search ..... 503/201, 200, 503/226

[56] References Cited

FOREIGN PATENT DOCUMENTS

| | | | |
|---|---|---|---|
| 00710572A1 | 5/1996 | European Pat. Off. | 503/227 |
| 6-115244 | 4/1994 | Japan | 503/227 |

*Primary Examiner*—Bruce H. Hess

*Attorney, Agent, or Firm*—Sughrue, Mion, Zinn, Macpeak & Seas, PLLC

[57] ABSTRACT

The reversible heat-sensitive recording material of the present invention has a substrate and provided thereon a reversible heat-sensitive recording layer containing an organic low molecular weight substance and is provided with an adhesive layer on an opposite face to the reversible heat-sensitive recording layer via a cushioning layer.

Not only the reversible heat-sensitive recording material of the present invention can readily be recorded and erased repeatedly by heating but also it can readily be adhered as well on an object having large unevenness and undulations on a surface, and it can be applied for displaying a visible information in various cards.

5 Claims, 1 Drawing Sheet

REVERSIBLE HEAT-SENSITIVE RECORDING MATERIAL

TECHNICAL FIELD

The present invention relates to a reversible heat-sensitive recording material which has a cushion layer and can reversibly repeat to form and erase an image based on a temperature change. Further, the present invention relates to a magnetic card using this reversible heat-sensitive recording material.

TECHNICAL BACKGROUND

In recent years, a progress in a thermal head is accompanied with utilization of a heat-sensitive recording material which has rapidly been expanding. In particular, in a prepaid card which has rapidly getting popular in the fields of communication, transportation and distribution, a magnetic information is shown on a card face as a visible information in many cases. Such the magnetic card is widely used as a high way card, a JR Orange card, an Io card, or a prepaid card in a department store and a super market.

However, an area in which the visible information can be expressed on such the magnetic card is limited, and in case of an expensive prepaid card, successive recording of the balances thereof leads to impossibility to display the information in some cases. In such the case, a new card is usually reissued to cope therewith, which raises a cost.

In order to solve such the problems, a reversible recording material in which recording and erasing can be carried out plural times on the same area is preferably used. Use of such the material makes it possible to erase an old information and display a new information and therefore, reissue of a new card due to impossibility of displaying the informations is not necessary.

There have so far been proposed as a heat sensitive recording material which can thus rerversibly record and erase the informations, those having a heat-sensitive recording layer in which an organic low molecular weight substance such as a higher alcohol or a higher fatty acid is dispersed in a resin matrix such as a polyvinyl chloride, a vinyl chloride-vinyl acetate copolymer, a polyester, and a polyamide [JP-A-55-154198 (the term "JP-A" as used herein means an unexamined published Japanese patent application)].

Formation and erasion of an image with such the material is carried out by utilizing a reversible change in a transparency in a heat-sensitive recording layer by a temperature. That is, this recording material shows a transparent state at some temperature ($t_1$ to $t_1'$, provided that $t_1<t_1'$) and shows an opaque state at a temperature higher than $t_1'$. A thermal head is preferred as a heating means for a recording layer particularly in the case that the recording layer is provided on the magnetic card. That is, a transparent state is set at an initial stage and then the portion is turned opaque by heating to a temperature higher than that ($t_1'$) of a thermal head to record a character and a pattern. Alternatively, an opaque state may be set at the initial stage and then the portion may be turned transparent by heating to a temperature ($t_1$ to $t_1'$) with the thermal head for recording. In erasing these, it is heated to a temperature of ($t_1$ to $t_1'$) in a former case and to a temperature higher than ($t_1'$) in a latter case with a heat roll or a thermal head.

Usually, a method in which a reversible recording material is coated directly on a card member is the most practical as a method for providing the reversible recording material on the card. For example, where it is desired to partially provide a recording area, it is easier to adhere them with an adhesive. Because of this, the present inventors tried to prepare a recording material having provided the reversible heat-sensitive recording material on one face of a substrate and an adhesive layer on the another face thereof. However, in recent years, such the recording material was used to provide a memory card and an IC card which are used for an electronic pocketbook with a function of a visible display, but even adhesion with a conventional adhesive as well as coating directly on a card generated an uneven color development and a blurred character due to large irregularities and undulations on the card, which prevented a tight contact to a thermal head.

The object of the present invention is to provide a reversible heat-sensitive recording material which can reversibly repeat to form and erase a record by heat and can readily be applied even to a substance having large irregularities and undulations, and various cards using this.

DISCLOSURE OF THE INVENTION

That is, the present invention is to provide a reversible heat-sensitive recording material which is characterized in that in a reversible heat-sensitive recording material comprising a substrate and provided thereon a reversible heat-sensitive recording layer containing an organic low molecular weight substance, an adhesive layer is provided on an opposite face to the reversible heat-sensitive recording layer via a cushion layer.

An information can repeatedly be recorded and erased on the heat-sensitive recording layer in the recording material of the present invention and the information can be recorded visually on the heat-sensitive layer with a heating recording equipment such as a thermal head. Further, reloading and renewal of an information is possible with the same equipment, in which the information is readily erased and rerecorded.

EXPLANATION OF THE SIGNALS

Figure 1:
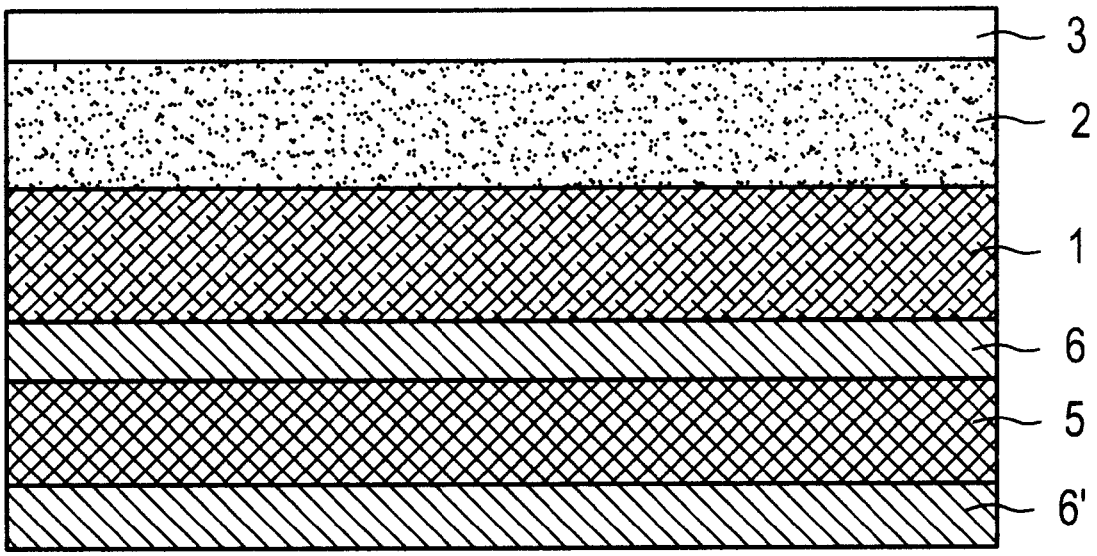
FIG. 1 is a schematic cross-sectional view showing one specific example of the recording material of the present invention.

1. Substrate.
2. Reversible heat-sensitive recording layer.
3. Overcoat layer.
4. Cushioning adhesive layer.
5. Foamed substrate.
6. Adhesive layer.

6'. Adhesive layer.

BEST MODE FOR EMBODYING THE INVENTION

Next, the reversible heat-sensitive recording material of the present invention will specifically be explained with reference to the drawing. FIG. 1 is a schematic cross-sectional view showing one specific example of the recording material of the present invention. In FIG. 1, the reversible heat-sensitive recording layer 2 is provided on one face of the substrate 1 and further, the overcoat layer 3 is provided thereon. Meanwhile, a back face of the above substrate 1 comprises the foamed substrate 5 as a cushion layer, and the adhesive layer 6 and the adhesive layer 6' which are provided on the both faces thereof, and the assembly is adhered to the substrate 1 via the adhesive layer 6.

The resin matrix used in the reversible heat-sensitive recording layer in the recording material of the present invention forms a layer in which an organic low molecular weight substance is uniformly dispersed and maintained, and greatly affects a transparency at a maximum transparence. Therefore, the resin matrix preferably is a resin having a good transparency, a mechanical stability and an excellent film formability. Examples of such the resin are a vinyl chloride copolymer such as a polyvinyl chloride, a vinyl chloride-vinyl acetate copolymer, a vinyl chloride-vinyl acetate-vinyl alcohol copolymer, or a vinyl chloride-acrylate copolymer; a vinylidene chloride copolymer such as a polyvinylidene chloride, a vinylidene chloride-vinyl chloride copolymer, or a vinylidene chloride-acrylonitrile copolymer; a polyvinyl acetal resin such as a polyester, a polyamide, a polyvinyl formal, or a polyvinyl butyral; an acrylic resin such as a polyacrylate, a polymethacrylate or an acrylate-methacrlate copolymer; a thermoplastic resin such as a silicon resin, a polystyrene, a styrene-butadiene copolymer, a polyacrylate, a polycarbonate, a polysulfone, an aromatic polyamide, a phenoxy type resin, or a cellulose resin; and other thermosetting resins. Those resin matrixes can be used alone as in a mixture of two or more thereof.

Higher fatty acid, particularly at least one of higher fatty acids having 16 or more carbon atoms is used as the organic low molecular weight substance described above which is blended with a heat-sensitive recording layer. Specific examples of such higher fatty acids having 16 or more carbon atoms include palmitic acid, margaric acid, stearic acid, nonadecanoic acid, eicosanoic acid, heneicosanoic acid, behenic acid, lignoceric acid, pentacosanoic acid, cerotic acid, heptacosanoic acid, montanoic acid, triacontanoic acid, nonacosanoic acid, melissic acid, 2-hexadecenoic acid, trans-3-hexadecenoic acid, 2-heptadecenoic acid, trans-2-octadecenoic acid, cis-2-octadecanoic acid, trans-4-octadecenoic acid, 2-heptadecenoic acid, cis-6-octadecenoic acid, elaidic acid, baseninoic acid, trans-gondoinoic acid, erucic acid, brassic acid, brassidic acid ceracoleic acid, trans-ceracoleic acid, trans-8-octadecadienoic acid, trans-10-octadecadienoic acid, linoelaidic acid, α-eleostearic acid, β-eleostearic acid, pseudoeleostearic acid, and 12,20-heneicosadienoic acid. Those may be used alone or in a mixture of two or more thereof.

Further, there may be added for expanding a transparence temperature region in the heat-sensitive recording layer, a conventional component such as succinic acid, glutaric acid, adipic acid, pimelic acid, suberic acid, azelaic acid, sebacic acid, undecanoic diacid, dodecanoic diacid, tridecanoic diacid, tetradecanoic diacid, pentadecanoic diacid, hexadecanoic diacid, heptadecanoic diacid, octadecanoic diacid, nonadecanoic diacid, eicosanoic diacid, heneicosanoic diacid, docosanoic diacid, tricosanoic diacid, tetracosanoic diacid, pentacosanoic diacid, or hexacosanoic diacid.

Sulfide represented by a formula: $HOOC(CH_2)_m—S—CH_2)_nCOOH$ (in the formula, m and n each individually represents an integer of 1 to 5) is most preferred as such the organic low molecular weight substance. Combining such the sulfide with the higher fatty acid having 16 or more carbon atoms can realize shifting the transparence temperature region to a higher temperature side and expansion of the region width thereof. Specific examples of the sulfide described above include (1,1'-dicarboxy)dimethylsulfide, (2,2'-dicarboxy)-diethylsulfide (thiodipropionic acid), (3,3'-dicarboxy)-dipropylsulfide, (1,2'-dicarboxy) methylethylsulfide, (1,3'-dicarboxy)methylpropyl-sulfide, (1,4'-dicarboxy)methylbutyl-sulfide, (2,3'-dicarboxy) ethylpropylsulfide, (2,4'-dicarboxy)ethylbutylsulfide, and (5,5'-dicarboxy)dipentylsulfide. Thiodipropionic acid is particularly preferred. These may be used alone or as a mixture of two or more kinds.

The compounding proportion of the higher fatty acid to the sulfide such as thiodipropionic acid is 90:10 to 10:90, preferably 90:10 to 30:70, and more preferably 85:15 to 50:50 by weight ratio. The sulfide less than the above range makes expansion of a transparence temperature width insufficient. Meanwhile, the sulfide more than that lowers a contrast.

Further, the compounding proportion of the organic low molecular weight substance contained in the heat-sensitive recording layer to the resin matrix is that the resin matrix is preferably about 50 to 1600 parts by weight, and more preferably 100 to 500 parts by weight, per 100 parts by weight of the organic low molecular weight substance. If the amount of the matrix compounded is less than 50 parts by weight, it becomes difficult to form a film in which the organic low molecular weight substance is stably maintained in the matrix. On the other hand, the matrix exceeding 1600 parts by weight is not preferred as a recording material since an amount of the organic low molecular weight substance which becomes opaque is decreased and therefore a recorded information which is written cannot clearly be read. It is preferred that the organic low molecular weight substance is uniformly dispersed in the matrix and sufficiently fixed, and it may be partially compatible with the matrix.

A thickness of the reversible heat-sensitive recording layer in which the organic low molecular weight substance is dispersed in the resin matrix varies depending on the purpose of use, but is usually preferably 1 to 20 μm. The thickness less than this range is not practical as a recording material since a sufficient contrast is not obtained, and that exceeding this range causes deterioration of a contrast since sufficient heat is not transmitted.

In addition to the higher fatty acid, the sulfide and the resin matrix described above, various additives may be added to the reversible heat-sensitive recording layer according to necessity. There may be added as the additive, an inorganic or organic filler as well as a lubricant, an antistatic agent, a plasticizer, a dispersant, a stabilizer, and a surface active agent.

A solvent used for forming the heat-sensitive recording layer may variously be selected according to the kinds of the matrix and the organic low molecular weight substance, and it includes, for example, tetrahydrofuran, methyl ethyl ketone, methyl isobutyl ketone, chloroform, carbon tetrachloride, ethanol, toluene, and benzene. Not only in the case that a dispersion liquid is used but also in the case that a solution is used, the organic low molecular weight substance is deposited in the form of a fine particle and present in a dispersed state in the heat-sensitive recording layer.

A film of a plastic such as polyethylene terephthalate or polypropylene, a paper, a synthetic paper, and a metal which are conventional materials are used as a substrate used for the recording material of the present invention.

In general, in order to form the heat-sensitive recording layer using the respective components described above, a solution obtained by dissolving two components of the resin matrix and the organic low molecular weight substance is prepared or a solvent which does not dissolve at least one of the organic low molecular weight substances is used to prepare a solution of the resin matrix. The organic low molecular weight substance is dispersed therein in the form of fine particles, and further, a dispersion liquid dissolving a high boiling solvent is prepared. These solutions prepared are coated on the above-described substrate by a conventional method and dried to form the heat-sensitive recording layer.

In order to improve a contrast, a reflection layer of a metal deposited film and a metal foil of, for example, aluminum may be provided between the reversible heat-sensitive recording material and the substrate.

An adhesive layer is provided on another face of the above substrate via a cushioning layer. A thickness of the cushioning layer is preferably 0.1 mm or more, and more preferably 0.2 to 1.5 mm so that it is not affected by unevenness and undulations of the substrate, and a thickness of the adhesive layer may suitably be determined. The cushioning layer may be of thick Japanese paper, thick non-woven fabric and felt in addition to the above-described foamed material (2 to 50 times foamed). Further, those obtained by impregnating the cushioning layer with an adhesive may be used.

Further, in order to prevent deterioration of the reversible heat-sensitive recording layer by heat and pressure of a heating equipment such as a thermal head in recording and erasing, struck traces in erasing and sticking in recording, and to improve a recyclability, an overcoat layer may be provided on the heat-sensitive layer. There may be used for such the overcoat layer, silicon type, acrylic, fluorine type, epoxy type and urethane type organic substances or inorganic substances such as $SiO_2$, SiO, MgO, ZnO, $TiO_2$, $Al_2O_3$, AlN, and $Ta_2O_3$. Further, thermosetting, electron beam-curing and UV-curing resins may be used for the overcoat layer.

Such the overcoat layer can be formed by a conventional coating method or vacuum deposition method. In case of the organic substance, the thickness thereof is 0.1 to 10 $\mu$m, preferably 0.1 to 5 $\mu$m. The thickness less than this decreases an effect of the overcoat layer. On the other hand, the thickness more than this brings about lowering of a contrast, and neither of them is preferred.

Further, in order to improve a durability, an intermediate layer may be provided between the reversible heat-sensitive recording material and the overcoat layer. The intermediate layer may include a thermoplastic resin such as polyvinyl chloride, polyvinylidene chloride, polyester, polyamide, polyacrylate, polymethacrylate, polystyrene, nitrocellulose, ethyl cellulose, polyvinyl alcohol, polyvinyl formal, or polyvinyl butyral, and in addition thereto, polyimide type and polyurethane type thermosetting resins, and photosetting resins by an ultraviolet ray and an electron beam. A thickness of the intermediate layer also is preferably 0.1 to 10 $\mu$m, more preferably 0.1 to 5 $\mu$m because of the same reason as that for the overcoat layer.

The reversible heat-sensitive recording material of the present invention is suitably applied particularly to a magnetic card and an IC card. In this case, the reversible heat-sensitive recording layer may be adhered on either a surface of a card or the opposite face thereof. Also, it may be provided on the entire face of the card or at an arbitrary part.

The reversible heat-sensitive recording material of the present invention can widely be used for a magnetic card, an IC card, a highway card, various prepaid cards used in department stores and super markets, a JR Orange card, a stored fare card, a commuting ticket, an ID card, and a cash card (a bank card) each having the reversible heat-sensitive recording layer.

EXAMPLES

Next, the heat-sensitive recording material of the present invention will further specifically be explained with reference to the examples. "Part" used below means part by weight.

Example 1

| Composition | Added amount |
|---|---|
| Behenic acid ($C_{21}H_{43}COOH$) | 7 parts |
| Thiodipropionic acid | 3 parts |
| Vinyl chloride-vinyl acetate copolymer (VYHH manufactured by UCC) | 25 parts |
| 1,3-Pentadiene polymer | 2 parts |
| Tetrahydrofuran | 120 parts |

The solution prepared above was coated on an aluminum-deposited polyethylene terephthalate film (thickness: 100 $\mu$m) with a wire bar at a dry film thickness of 5 $\mu$m to obtain a heat-sensitive recording layer. Further, a coating solution consisting of 50 parts of an acrylic ultraviolet-curing resin (BR-370 manufactured by Asahi Denka Co., Ltd.) and 50 parts of methanol was coated as an overcoat layer at a dry thickness of 1 $\mu$m, and UV was irradiated (500 mJ) for curing.

Next, a double-sided adhesive sheet in which an acrylic adhesive layer having a thickness of 30 $\mu$m was provided on the both faces of a foamed polyethylene substrate (30 times foamed) having a thickness of 1.0 mm was adhered on the entire face of the side opposite the above reversible heat-sensitive recording layer.

The reversible heat-sensitive recording material thus prepared was adhered on a back face of an IC card and was subjected to solid printing on the entire face thereof with a line type thermal head (8 dot/mm, printing energy: 0.3 mJ/dot) to evaluate a color developability.

Example 2

A recording material was provided on a magnetic card in the same manner as in Example 1, except that the IC card was replaced with a magnetic card (thickness: 200 $\mu$m) in which the reversible heat-sensitive recording material provided with the cushioning adhesive layer was adhered on a face opposite the magnetic face of the magnetic card. This was evaluated in the same manner as in Example 1.

Comparative Example 1

A reversible heat-sensitive recording material was prepared in the same manner as in Example 1, except that an epoxy type adhesive [Araldite (a rapid type) manufactured by Showa Kobunshi Co., Ltd.] was coated at a thickness of 100 $\mu$m in place of the double-sided adhesive sheet using the foamed substrate. This was evaluated in the same manner as in Example 1.

Comparative Example 2

A sample was prepared and evaluated in the same manner as in Example 2, except that the solution for the reversible heat-sensitive recording layer which was used in Example 1 was coated directly on a face opposite the magnetic face of a magnetic card at a dry thickness of 5 μm and that a coating solution consisting of 50 parts of an acrylic UV-curing resin (BR-370 manufactured by Asahi Denka Co., Ltd.) and 50 parts of methanol was coated as an overcoat layer at a dry thickness of 1 μm, and a UV ray of 500 mJ was irradiated for curing.

The evaluation was conducted as described above to find that while in the card prepared in Example 1, the entire face was uniformly colored (opaque), in the card prepared in Comparative Example 1, a coloring irregularity was generated along the unevenness of the substrate. Further, while in the card prepared in Comparative Example 2, a low platen pressure was liable to generate coloring unevenness in a curl of the card, such phenomenon was not observed in the card prepared in Example 2.

Applicability on Industry:

Not only the reversible heat-sensitive recording material of the present invention can readily be recorded and erased repeatedly by heating but also it can readily be adhered as well on an object having large unevenness and undulations on a surface, and it can be applied for displaying a visible information in various cards.

We claim:

1. A reversible heat-sensitive recording material comprising a substrate and provided thereon a reversible heat-sensitive recording layer containing an organic low molecular weight substance, characterized in that an adhesive layer is provided on an opposite face to the reversible heat-sensitive recording layer via a cushioning layer.

2. A magnetic card in which the reversible heat-sensitive recording material as claimed in claim 1 is provided on a magnetic card member.

3. An IC card on which the reversible heat-sensitive recording material as claimed in claim 1 is adhered.

4. The reversible heat-sensitive recording material as claimed in claim 1, wherein said cushioning layer is foamed.

5. The reversible heat-sensitive recording material as claimed in claim 1, wherein said cushioning layer is selected from the group consisting of thick Japanese paper, thick non-woven fabric and felt.

* * * * *